US005870840A

United States Patent [19]

Geils et al.

[11] Patent Number: 5,870,840

[45] Date of Patent: Feb. 16, 1999

[54] STITCHERY FRAME AND STAND

[76] Inventors: Neal Geils, 2338 Kipland Dr., Santa Rosa, Calif. 95401; Victoria Meyer, 1715 Norte Way, Santa Rosa, Calif. 95404

[21] Appl. No.: 948,960

[22] Filed: Oct. 10, 1997

[51] Int. Cl.[6] ..... D06C 3/06

[52] U.S. Cl. ..... 38/102.21

[58] Field of Search ..... 38/102.21, 102.4, 38/102.8, 102.5, 102.9, 102.91; 108/1, 3, 6, 10, 32, 155; 248/133, 371, 398, 188.2, 188.8

[56] References Cited

U.S. PATENT DOCUMENTS

| | | | |
|---|---|---|---|
| 308,406 | 11/1884 | Elder | 38/102.21 |
| 566,049 | 8/1896 | Wolford | 38/102.21 |
| 737,804 | 9/1903 | Walt | 38/102.21 |
| 811,650 | 2/1906 | Massey | 38/102.21 |
| 1,020,295 | 3/1912 | Lewis | 38/102.21 |
| 2,000,397 | 5/1935 | Knutson | 38/102.21 |
| 3,805,710 | 4/1974 | Leshem | 108/6 |
| 3,899,164 | 8/1975 | Newman | 269/71 |
| 3,938,267 | 2/1976 | Bard | 38/102.1 |
| 3,955,722 | 5/1976 | Bard | 223/106 |
| 4,102,065 | 7/1978 | Selden | 38/102.1 |
| 4,415,149 | 11/1983 | Rees | 248/371 X |
| 4,665,638 | 5/1987 | Morton | 38/102.1 |
| 4,921,302 | 5/1990 | Godwin | 108/1 X |

*Primary Examiner*—Ismeal Izaguirre
*Attorney, Agent, or Firm*—Jack Lo

[57] ABSTRACT

A stitchery scroll frame includes front and rear rollers extending transversely between side members. A stand for holding the scroll frame includes a pair of front legs and a pair of rear legs. The scroll frame is removably attached to the top of the legs by C-clips. The legs of the stand include height adjustable upper and lower sections. The front and rear legs may be adjusted to uneven heights for inclining the scroll frame. The legs on either side of the stand are connected by cross braces, which can be detached from the legs for disassembling the stand.

3 Claims, 2 Drawing Sheets

STITCHERY FRAME AND STAND

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to stitchery scroll frames and stands for supporting them.

2. Prior Art

Large pieces of stitchery work, such as quilts or rugs, are commonly made by mounting the work on a large frame, and supporting the frame on a stand. Some frames are simple rectangular structures in which the work piece is stretched. Other frames are scroll frames that include a pair of side members, and a pair of rollers extending transversely between the side members. Opposite ends of a long work piece are stapled to the rollers, and scrolled from one roller to the other as the work progressed. The side edges of the work piece tend to flex when a user rests her hands on it, which makes the work piece unstable to work on.

U.S. Pat. No. 3,899,164 to Newman shows a stand with a pair of articulated vertical arms with clamps at the ends for gripping a large stitchery frame. A cross brace extending between the arms is adjustable in length for spacing the arms to fit frames of different widths. The arms are pivoted for tilting the frame to a desired working angle, but the stand may tip over if the frame is too large. U.S. Pat. No. 3,938,267 to Bard also shows a stand with an adjustable cross brace. A scroll frame is supported between a pair of vertical arms. The frame is pivoted about a pair of bolts. The angle of the frame is secured by wing nuts on the bolts. The small wing nuts cannot hold the frame securely enough, so that the frame may be inadvertently rotated when a user rests her arms on the frame. U.S. Pat. No. 4,102,065 to Selden shows a stand with a recess that can only hold a frame of a single size. The angle of the frame is adjusted by struts that precariously engage notches under support arms. The struts may easily disengage from the notches when the stand is flexed sideways, so that the frame may tip over and fall off the stand.

OBJECTS OF THE INVENTION

Accordingly an object of the present invention is to provide a stitchery scroll frame for mounting a large work piece.

Another object of the present invention is to provide a stitchery scroll frame that is adjustable for mounting work pieces of different sizes.

Another object of the present invention is to provide a stitchery scroll frame that secures the side edges of the work piece to prevent it from flexing.

Another object of the present invention is to provide a stand for stably holding the scroll frame.

Another object of the present invention is to provide a stand that is adjustable for holding the scroll frame at a wide range of angles.

Another object of the present invention is to provide a stand that securely holds the scroll frame at a selected angle.

Another object of the present invention is to provide a stand that is adjustable for holding the scroll frame when the frame is adjusted to mount work pieces of different sizes.

Still another object of the present invention is to provide a stand that can be disassembled for compact storage and transportation.

Further objects of the present invention will become apparent from a consideration of the drawings and ensuing description.

BRIEF SUMMARY OF THE INVENTION

A stitchery scroll frame includes rollers extending transversely between side members. A stand for holding the scroll frame includes a pair of front legs and a pair of rear legs. The scroll frame is attached to the top of the legs by C-clips, which enable the frame to be easily attached and removed. Each leg of the stand includes upper and lower sections that are adjustable for height. The front and rear legs may be adjusted to different heights for inclining the frame. The legs on either side of the stand are connected by adjustable cross braces.

DRAWING REFERENCE NUMERALS

| | |
|---|---|
| 10. Scroll Frame | 11. Stand |
| 12. Front Roller | 13. Side Members |
| 14. Rear Roller | 15. Slit |
| 16. Hole | 17. Knob |
| 18. Hole | 19. Front Legs |
| 20. Rear Legs | 21. Upper Section |
| 22. Lower Section | 23. Knobs |
| 24. Shafts | 25. Side Braces |
| 26. C-Clips | 27. Cross Braces |
| 29. First Members | 30. Knobs |
| 31. Second Members | 32. Slots |
| 33. Shafts | 34. Brackets |
| 35. Bolts | 36. Wing Nuts |
| 37. Shafts | 38. Shaft |
| 39. Work Piece | 40. Cord |
| 41. Left Support assembly | 42. Right Support assembly |
| 43. Semi-Cylindrical Halves | 44. Fabric Anchor Strips |

DETAILED DESCRIPTION OF THE INVENTION

Figure 1:
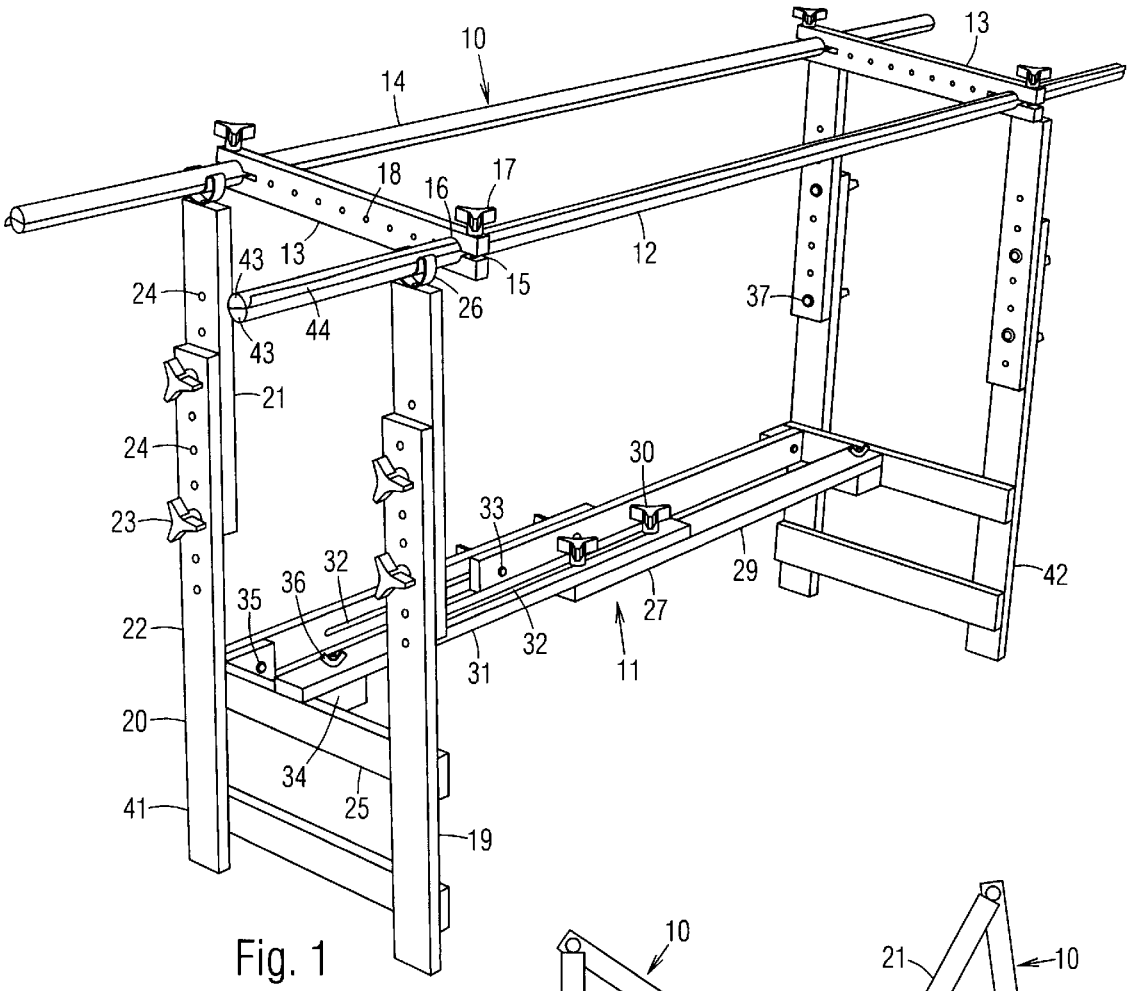
FIG. 1 is a side perspective view of a stitchery frame and stand in accordance with the invention.

In accordance with a preferred embodiment of the invention shown in the side perspective view of FIG. 1, an adjustable scroll frame 10 is supported on an adjustable stand 11. Scroll frame 10 includes transverse front and rear rollers 12 and 14 extending through the ends of elongated side members 13. Rollers 12 and 14 are preferably each made of semi-cylindrical wooden halves 43 glued together. A wooden dowel made of a single piece of wood tends to warp, but forming a roller from a pair of semi-cylindrical wooden halves prevents warping. Fabric anchor strips 44 extend along the rollers.

Rollers 12 and 14 are sized for mounting a large work piece (not shown), so that they are preferably about 2 meters long. The ends of the work piece are sewn to anchor strips 44 or stapled to the rollers, and scrolled from one roller to the other as work progressed. A slit 15 extends inwardly from each end of side members 13, across a hole 16 through which is inserted a roller. A knob 17 attached to each end of side members 13 is adjustable for tightening a roller, or releasing it for rotation. A series of holes 18 are arranged along each side member 13.

Stand 11 includes left and right support assemblies 41 and 42 each including a front leg 19 and a rear leg 20. Each leg includes an upper section 21 and a lower section 22. Shafts 37 of leg adjusting means or knobs 23 removably extend through regularly spaced holes 24 on upper and lower sections 21 and 22. Front and rear legs 19 and 20 are connected at their lower portions by side braces 25 fixedly connected therebetween. Rollers 12 and 14 are removably and rotatably secured on the upper ends of legs 19 and 20 by an attaching means or C-clip 26. Adjustable cross braces 27 extend transversely between left and right support assemblies 41 and 42. Each cross brace 27 includes a first member 29 with a pair of knobs 30 arranged at fixed positions thereon, and a second member 31 with a longitudinal slot 32. Shafts 33 of knobs 30 extend through slots 32. The ends of cross braces 27 are removably attached to brackets 34 fixedly attached to side braces 25 by bolts 35 and wing nuts 36.

Figure 2:
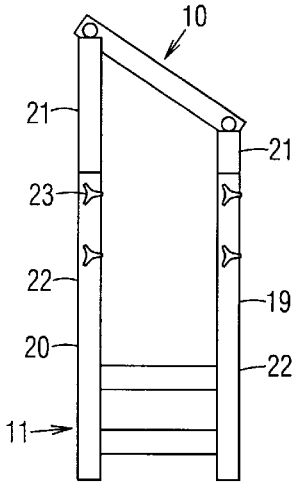
FIG. 2 is a side view of the stitchery frame and stand after the stand has been adjusted to hold the frame at a more inclined angle.
Figure 3:
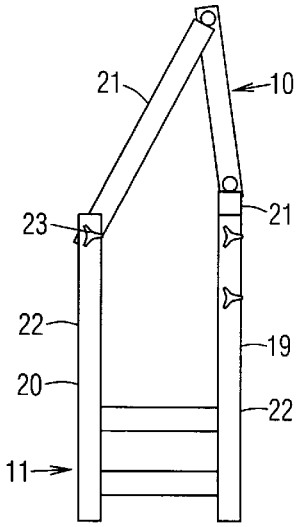
FIG. 3 is a side view of the stitchery frame and stand after the stand has been adjusted to hold the frame at an almost vertical angle.

Frame 10 can be adjusted for mounting work pieces of different widths by sliding side members 13 closer together or farther apart along rollers 12 and 14. The width of stand 11 can also be adjusted to suit by loosening knobs 30, compacting or extending cross braces 27, and tightening knobs 30. C-clips 26 enable frame 10 to be easily removed and reattached to stand 11. The height of frame 10 can be adjusted by simultaneously adjusting the heights of front and rear legs 19 and 20. The working angle of frame 10 can be adjusted by adjusting front and rear legs 19 and 20 to uneven heights. For example, frame 10 can be adjusted to a more inclined angle by making rear legs 20 much taller than front legs 19, as shown in FIG. 2. Frame 10 can be adjusted to a nearly vertical position by removing one of knobs 23 from each rear leg 20, and connecting the bottom end of upper section 21 to the top end of lower section 22 with a single knob 23, as shown in FIG. 3.

Upper and lower sections 21 and 22 are securely connected by shafts extending through holes therein. The legs cannot be compacted even when a user leans on frame 10 with her arms, so that frame 10 is securely held at a selected angle. The adjustment of the legs is limited to position frame 10 rearward of front legs 19, such as shown in FIG. 3, so that stand 11 cannot be adjusted to an unstable condition. When not in use, stand 11 may be disassembled by removing frame 10, removing wing nuts 36 and bolts 35, and separating cross braces 27 from the legs.

Figure 4:
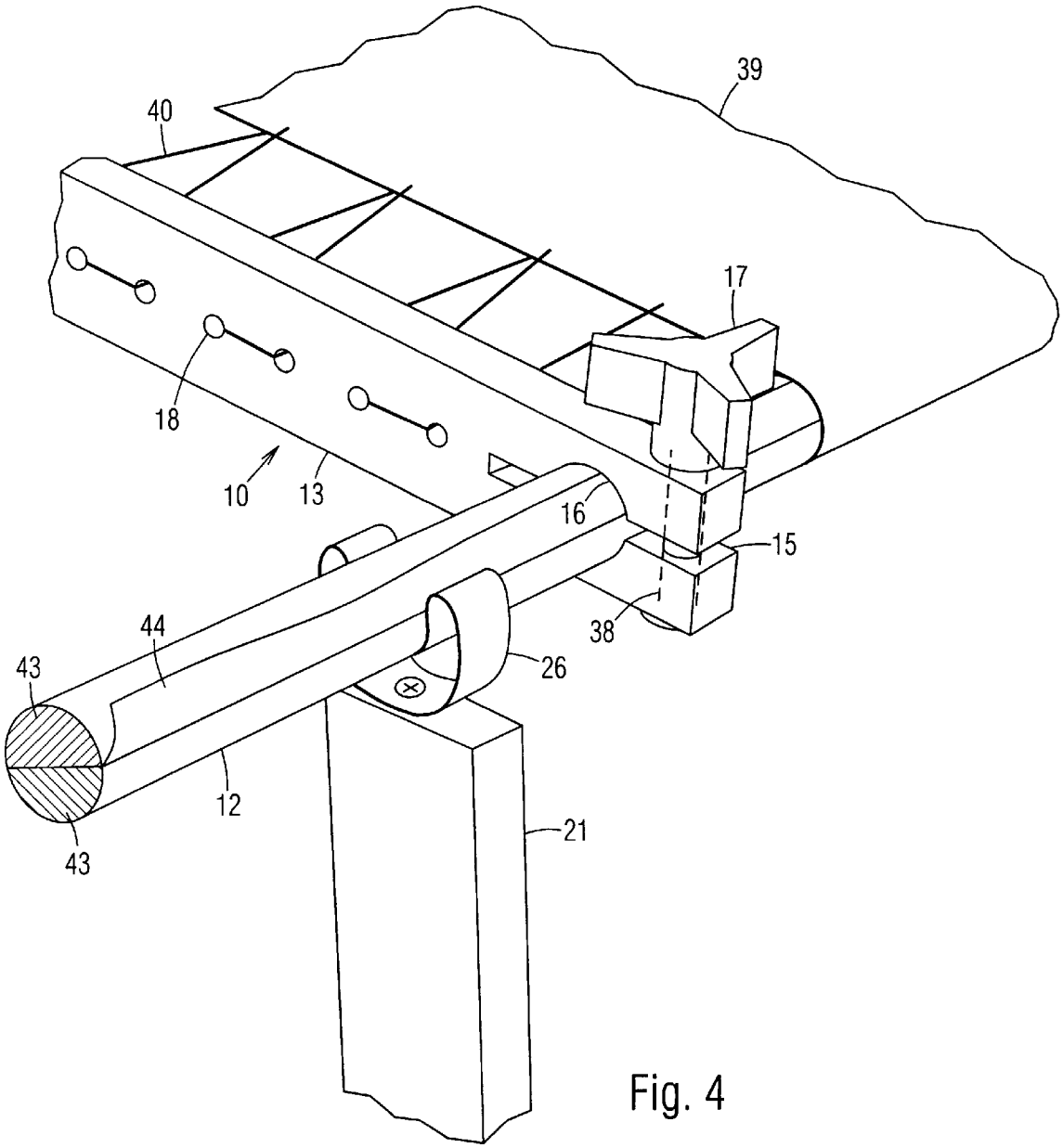
FIG. 4 is a detailed perspective view of the stitchery frame and stand.

As shown in a close-up view of one corner of frame 10 in FIG. 4, each knob 17 is attached to the upper end of a shaft 38 extending through an end of side member 13, and through slit 15. Rollers 12 and 14 can thus be locked by tightening knob 17. A work piece 39 is shown mounted in frame 10. Each side edge of work piece 39 may be secured to a corresponding side member 13 by a cord 40 sewn thereon and tightly threaded through holes 18 on side member 13. Work piece 39 is thus stretched taut in both the longitudinal and transverse directions, so that it is substantially prevented from flexing to provide a stable working surface.

SUMMARY AND SCOPE

Accordingly, I have provided a stitchery frame for mounting a large work piece. The frame is adjustable for mounting work pieces of different sizes. The side edges of the work piece can be secured to the frame to prevent it from flexing. A stand is also provided for stably holding the frame. The stand is adjustable for holding the frame at a wide range of angles, and securely holding the frame at a selected angle. The stand is adjustable for holding the frame when the frame is adjusted to mount work pieces of different sizes. The stand can also be disassembled for compact storage and transportation.

Although the above descriptions are specific, they should not be considered as limitations on the scope of the invention, but only as examples of the embodiments. Many substitutes and variations are possible within the teachings of the invention. For example, instead of discrete holes 24, legs 19 and 20 may include slots for increased adjustability. The legs and cross braces may comprise of telescopic tubular sections. The front legs may be of a fixed height, so that only the rear legs are height adjustable. Instead of C-clips 26, other attaching means may be used for attaching frame 10 to stand 11. Cross braces 27 may be non-adjustable, and they may be non-removably attached to the legs. Therefore, the scope of the invention should be determined by the appended claims and their legal equivalents, not by the examples given.

I claim:

1. A stand for supporting a stitchery scroll frame having a front roller and a rear roller, comprising:

a left support assembly and a right support assembly each including a height adjustable front leg and a height adjustable rear leg, the front legs for supporting said front roller, and the rear legs for supporting said rear roller, the front legs and the rear legs being adjustable to uneven heights for inclining said scroll frame to a desired working angle;

a cross brace extending between said left support assembly and said right support assembly, said cross brace comprising a first member adjustably connected to a second member for varying a length of said cross brace;

a slot extending along said second member, a shaft extending through said first member and said slot, and a knob arranged on one end of said shaft tightening said first member to said second member; and attaching means arranged on each of the legs for attaching said front roller to the front legs, and said rear roller to the rear legs.

2. A stitchery apparatus, comprising:

a scroll frame including:

a pair of elongated side members each having opposite ends;

a hole adjacent each of said ends of said side members;

a slit extending into each of said ends and across said hole;

a knob attached to one end of a shaft extending across each of the slits; and a front roller and a rear roller extending transversely between said side members, and through corresponding holes in said opposite ends;

a stand including:

a left support assembly and a right support assembly each including a front leg and a height adjustable rear leg;

a cross brace extending between said left support assembly and said right support assembly, said cross brace comprising a first member adjustably connected to a second member for varying a length of said cross brace;

a slot extending along said second member, a shaft extending through said first member and said slot, and a knob arranged on one end of said shaft; and attaching means arranged on each of the legs attaching said front roller to the front legs, and said rear roller to the rear legs, the rear legs being adjustable to different heights so as to incline said scroll frame to different angles; and

3. A stitchery apparatus, comprising:

a scroll frame including:

a pair of elongated side members each having opposite ends;

a hole adjacent each of said ends of said side members;

a slit extending into each of said ends and across said hole;

a knob attached to one end of a shaft extending across each of the slits;

a front roller and a rear roller extending transversely between said side members, and through corresponding holes in said opposite ends; and a plurality of holes arranged on each of said side members of said frame for threading a cord therethrough, said cord stitched to a corresponding side edge of a work piece mounted in said frame; and a stand including:

a left support assembly and a right support assembly each including a front leg and a height adjustable rear leg;

a cross brace extending between said left support assembly and said right support assembly; and attaching means arranged on each of the legs attaching said front roller to the front legs, and said rear roller to the rear legs, the rear legs being adjustable to different heights so as to incline said scroll frame to different angles.

* * * * *